US008278582B2

(12) United States Patent
Tu et al.

(10) Patent No.: US 8,278,582 B2
(45) Date of Patent: Oct. 2, 2012

(54) HEAT DISSIPATING MEANS FOR CIRCUIT-BREAKER AND CIRCUIT-BREAKER WITH SUCH A HEAT DISSIPATING MEANS

(75) Inventors: Zhanwei Tu, Xiamen (CN); Shailendra Singh, Maharashtra (IN)

(73) Assignee: ABB Technology Ltd., Zurich (CH)

( * ) Notice: Subject to any disclaimer, the term of this patent is extended or adjusted under 35 U.S.C. 154(b) by 211 days.

(21) Appl. No.: 12/746,206

(22) PCT Filed: Dec. 5, 2008

(86) PCT No.: PCT/CN2008/001971

§ 371 (c)(1),
(2), (4) Date: Jun. 4, 2010

(87) PCT Pub. No.: WO2009/074016

PCT Pub. Date: Jun. 18, 2009

(65) Prior Publication Data

US 2010/0282713 A1 Nov. 11, 2010

(30) Foreign Application Priority Data

Dec. 7, 2007 (WO) ..... PCT/CN2007/071203

(51) Int. Cl.
*H01H 33/66* (2006.01)

(52) U.S. Cl. ..... 218/118; 200/289; 361/676

(58) Field of Classification Search ..... 218/118; 200/289; 361/676

See application file for complete search history.

(56) References Cited

U.S. PATENT DOCUMENTS 3,662,137 A * 5/1972 Cleaveland ..... 200/289
4,005,297 A * 1/1977 Cleaveland ..... 218/118

(Continued)

FOREIGN PATENT DOCUMENTS

CN 1427431 A 7/2003

(Continued)

OTHER PUBLICATIONS

The State Intellectual Property Office, P.R. China, International Search Report re International Application No. PCT/CN2007/071203, dated Sep. 4, 2008.

(Continued)

*Primary Examiner* — Truc Nguyen

(74) *Attorney, Agent, or Firm* — Anthony M. Del Zoppo, III; Driggs, Hogg, Daugherty & Del Zoppo Co., LPA

(57) ABSTRACT

The present invention discloses a circuit breaker comprising: a vacuum chamber; a fixed contact and a movable contact disposed in a vacuum chamber; a fixed contact stem supporting said fixed contact in said vacuum chamber and extending outwards from a first end of said vacuum chamber; a movable contact stem supporting said movable contact in said vacuum chamber for reciprocal movement between contact with and separated from said fixed contact, and extending outwards from a second end of said vacuum chamber; a first electrical conductor coupled to said fixed contact stem; a second electrical conductor coupled to said movable contact stem; at least one heat dissipating means disposed for at least one of said fixed contact and movable contact; wherein, the heat dissipating means is hollow and has an external surface and internal surface; a plurality of fins provided on said internal surface constitute a passage through which air is convected in a direction parallel to that of reciprocal movement of movable contact stem.

21 Claims, 8 Drawing Sheets

U.S. PATENT DOCUMENTS

| | | | | | |
|---|---|---|---|---|---|
| 4,123,618 | A | * | 10/1978 | Cushing et al. | 174/11 BH |
| 4,650,934 | A | * | 3/1987 | Burke | 200/5 R |
| 4,695,924 | A | * | 9/1987 | Wozniczka | 361/720 |
| 5,753,875 | A | * | 5/1998 | Benke et al. | 218/118 |
| 7,336,477 | B2 | * | 2/2008 | Weister et al. | 361/676 |

FOREIGN PATENT DOCUMENTS

| | | | |
|---|---|---|---|
| CN | 1474486 | A | 2/2004 |
| CN | 1787146 | A | 6/2006 |
| CN | 1787147 | A | 6/2006 |

OTHER PUBLICATIONS

The State Intellectual Property Office, P.R. China, International Search Report re International Application No. PCT/CN2008/001971, dated Mar. 12, 2009.

The State Intellectual Property Office, P.R. China, International Preliminary Report on Patentability re International Application No. PCT/CN2008/001971, dated Mar. 11, 2010.

* cited by examiner

HEAT DISSIPATING MEANS FOR CIRCUIT-BREAKER AND CIRCUIT-BREAKER WITH SUCH A HEAT DISSIPATING MEANS

RELATED APPLICATIONS

This application is a national filing of PCT application Serial No. PCT/CN2008/001971, filed Dec. 5, 2008, which claims priority of PCT application Serial No. PCT/CN2007/071203, filed Dec. 7, 2007.

TECHNICAL FIELD

The present invention relates to a circuit breaker, especially a circuit breaker for medium voltage. More specifically, the present invention relates to a heat dissipating means for dissipating heat generated by current conducted through the circuit breaker.

BACKGROUND ART

Circuit-Breakers (CB) are well known apparatus providing overload protection for devices, especially high-power devices, like engines, lines, transformers, generators or other such things. When a current flows through a CB, heat tends to be generated due to resistance of contacts, contact stems, and electrical conductors of CB. Given the resistance as a constant, for example, R, heat generated by a current I flowing there through should be approximately $I^2R$. In practice, the resistance R will increase along with the temperature of the contacts, the contact stems, and the electrical conductors due to the heat generated therein. Therefore, heat actually generated will be much more than that of theoretical calculation. Generally, heat generated in contacts, contact stems, and electrical conductors of a CB is disadvantages, because a high temperature raised by the heat may cause insulating elements to be worn out earlier, cause protecting electronics to function incorrectly, and even cause distortion to the contacts and contact stems, and eventually cause failure to the CB.

Therefore, how to dissipate heat generated with a CB has been a hot topic in the field for long, and various apparatus and methods have been developed for this topic.

FIG. 1 shows a polar armature disclosed in published Chinese patent application CN1427431. The polar armature comprises a polar end 2 and a polar base 3 each equipped with heat dissipating plates 9. This approach of dissipating heat applies to fixed CBs, but not to movable CBs. Further, since the polar armature is immerged in SF6 gas, insulation is not an important consideration of it.

Patent publication U.S. Pat. No. 5,753,875 discloses another approach of dissipating heat generated in a CB. In this publication, as shown in FIG. 2A, heat sinks 43 are placed on the fixed and movable contact stems to improve heat dissipation of the CB. FIG. 2B shows the construction of a heat sink 43 in detail. The heat sink 43 consists of a stack of laminations each having a central opening and radially extending slots which divide each of the laminations into a plurality of fingers. When assembled, the slots of the laminations form a plurality of axially extending passages through the heat sink. Air flowing through the passages will carry away heat from the sink, which improves heat dissipation of the CB. In practice, to dissipate heat efficiently, the size of such a heat sink should be very big, but available space for heat sinks in a CB, especially in a movable CB as shown in this publication, is quite limited. Further, charge concentration tends to be formed at corners of the fingers' tops, which is harmful to insulation of the CB.

Patent publication WO2006/040243 provides a solution to dissipate heat through a cooling element of a device for coupling one conductor to another, for example, coupling a contact stem of a CB to its moving contact. The structure of the device is shown in FIG. 3. As can be seen from FIG. 3, the structure of the coupling device is complicated, and requires additional space for the cooling element, which is a disadvantage for CBs where available space is quite limited.

BRIEF SUMMARY OF THE INVENTION

The present invention aims at providing an approach of dissipating heat generated in a CB while making more efficient use of the available space for a heat dissipating means in the CB. The invention will have no harm to insulation of the CB.

One embodiment of the invention is based on the concept of making use of both external surfaces and internal space of a heat dissipating means to improve heat dissipation while reducing requirement for space. In the embodiment, the heat dissipating means is designed such that cool air flows through it naturally and carries away heat generated in the CB efficiently.

According to one embodiment of the invention, there is provided a switching device. The switching device comprises a fixed contact and a movable contact disposed in a vacuum chamber, a fixed contact stem supporting said fixed contact in said vacuum chamber and extending outwards from a first end of said vacuum chamber; a movable contact stem supporting said movable contact in said vacuum chamber for reciprocal movement between contact with and separated from said fixed contact, and extending outwards from a second end of said vacuum chamber; a first electrical conductor connected to said fixed contact stem; and a second electrical conductor connected to said movable contact stem. The switching device further comprises at least one heat dissipating means for dissipating heat generated in the circuit breaker. The heat dissipating means has a hollow shape and comprises an external portion and an internal portion. An external and internal surface is formed on the external portion and internal portion respectively. The internal portion is constructed to form a passage for air convention there through. The direction of air convection is parallel to the direction of reciprocal movement of the movable contact stem. On the internal surface, a plurality of fins is provided to improve heat dissipation. An internal portion is constructed to accommodate the electrical conductor and forms an internal space. In another preferred embodiment, the internal and external portions are separated by a common wall, wherein the internal portion extends to an air passage and the external portion extends to another air passage which is different form the air passage of the internal portions.

In a preferred embodiment, the first electrical conductor is coupled to the fixed contact stem at a first junction; the second electrical conductor is coupled to the movable contact stem at a second junction; and the heat dissipating means is coupled to at least one of the first junction and second junction.

In another preferred embodiment, the heat dissipating means is fixed to said second junction of the circuit breaker, and the external portion is formed as a housing with a plurality of through slots formed on its external surface. That is, the slots extend from one edge (for example, the top edge) to the opposite edge (for example, the bottom edge) of the external surface. The fins are attached to a wall of the housing and extend inward on the internal surface. Further, the fins are separated from each other for air flowing through smoothly.

In still another preferred embodiment, the heat sink is fixed to said first junction of the circuit breaker and comprises a housing which is composed of three walls. Two of the walls are opposite and parallel to each other. The other wall is perpendicular to said two walls, and connects the two walls to form a "U" shaped housing. The two walls are in the form of barriers with a plurality of rails parallel to and separated from each other. A plurality of fins extends from each of the rails inwardly to the internal space of the housing. The fins are parallel to each other and perpendicular to the rails so as to form a plurality of comb like structures juxtaposed with and separated from each other.

In still another preferred embodiment, the switching device further comprises a coupling means for coupling an electrical conductor of a CB to its movable contact stem, wherein the coupling means comprises a first connecting element to connect the movable contact stem, and a second connecting element to connect the electrical conductor. The second connecting element is composed of flexible connecting means which is divided into a plurality of pieces to improve connecting reliability and increase heat dissipating surfaces.

In still another preferred embodiment, wherein the flexible connecting means is composed of at least three separated pieces.

In still another preferred embodiment, wherein each of the separated pieces is formed with at least one longitudinal slot thereon.

In still another preferred embodiment, wherein each of the pieces comprises a joint portion for connecting the second electrical conductor.

In still another preferred embodiment, wherein the joint portion is formed with at least one longitudinal slot by which the joint portion is divided into sub-pieces.

In still another preferred embodiment, wherein the first connecting element is formed with a hole to accommodate the movable contact stem, a flange being formed on the inner surface of said hole, and when installed, said flange engage with the end surface of said movable contact stem.

According to an embodiment of the present invention, the electrical conductor is a hollow cylinder with longitudinal slots thereon; wherein, the inner surface of the cylinder is formed with longitudinal ribs such that the inner surface is in undulation in the circumferential direction.

In still another preferred embodiment, wherein the first electrical conductor comprises a joint portion and a conducting portion, the conducting portion is in the form of a hollow cylinder with longitudinal slots on it, and the inner surface of the cylinder is formed with longitudinal ribs.

In still another preferred embodiment, wherein the second electrical conductor comprises a joint portion and a conducting portion, the conducting portion is in the form of a hollow cylinder with longitudinal slots on it, and the inner surface of the cylinder is formed with longitudinal ribs.

PREFERRED EMBODIMENTS OF THE INVENTION

Figure 9:
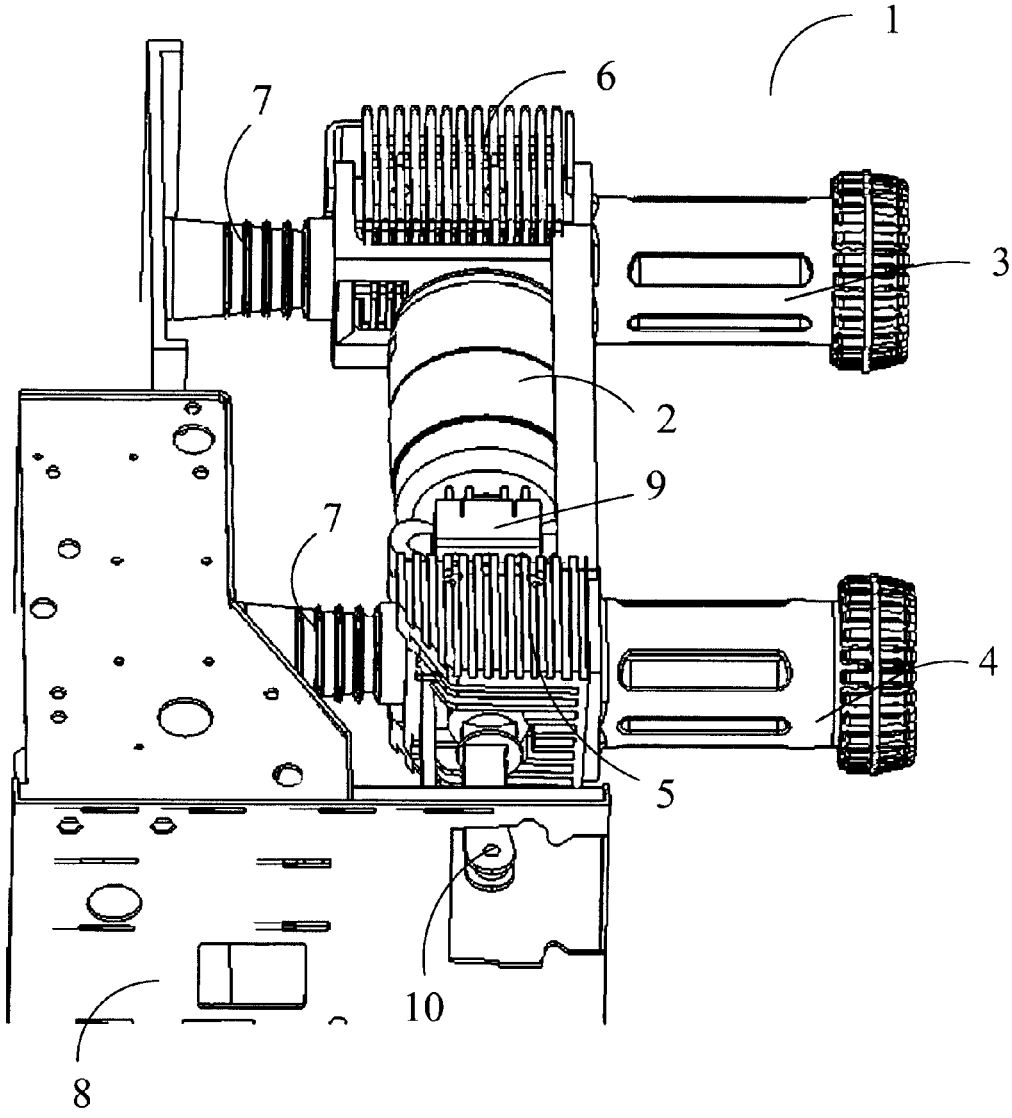
FIG. 9 shows a view of the assembly diagram of a CB according to the present invention, which comprises the dissipating means and the coupling means.

FIG. 9 shows a view of the assembly diagram of a switching device, for example, a circuit breaker (CB) 1 according to the present invention. The CB 1 comprises a vacuum chamber 2 housing a fixed contact and a movable contact (not shown) for connecting and/or interrupting a circuit. A corresponding fixed contact stem supports the fixed contact in the vacuum chamber 2 and extends outward from the upper end of the vacuum chamber 2, and a movable contact stem supports the movable contact in the vacuum chamber 2 and extends outward from the lower end of the vacuum chamber 2. The assembly of the second contact stem and the movable contact can move reciprocally in the vacuum chamber 2 to contact with and/or separate from the fixed contact. Above described is common principle for a CB, and is not shown in the drawings, but should be apparent for one skilled in the art. The CB of the present invention also comprises electrical conductors 3 and 4 for connecting the CB to a protected device (not shown), like an engine, a line, a transformer, or a generator. The CB further comprises a coupling means 9 to couple the movable contact stem to the electrical conductor 4, operating mechanism case 8 and insulators 7. The operating mechanism case 8 houses an operating mechanism for operating the CB. Insulators 7 insulate operating portions from load portions. According to FIG. 9, a heat dissipating element 5 is provided at the junction of the electrical conductor 3 and the fixed contact stem. Moreover, another heat dissipating element 6 is provided at the junction of the coupling element 9 and the electrical conductor 4. It should be noted that the heat dissipating elements can be placed on other positions where heat may conduct thereto. For example, the heat dissipating elements can be placed on the coupling means and conductors also. The heat dissipating element has better effect in the case of placing it closer to heat sources, such as contact, etc. in the circuit breaker. Further, an operating rod 10 is connected to the movable contact stem and operated by the operating mechanisms to switch on/switch off the CB.

Figure 1:
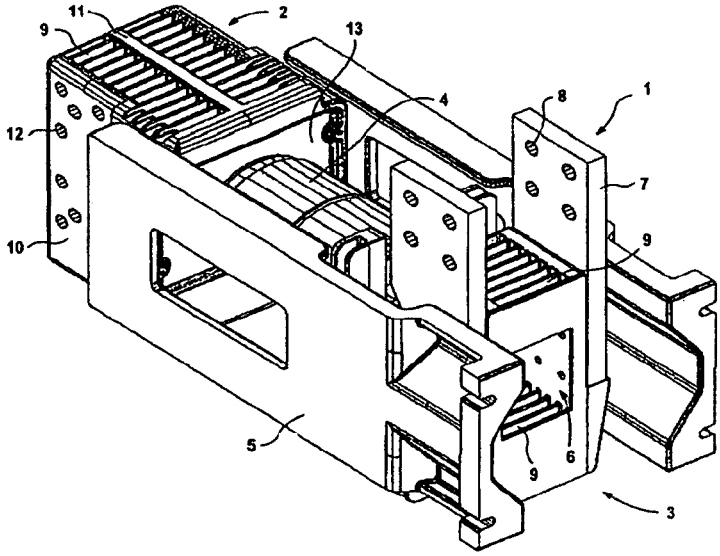
Fig. 1 Prior Art
FIG. 1 shows a conventional conducting device with a cooling element.
Figure 2A:
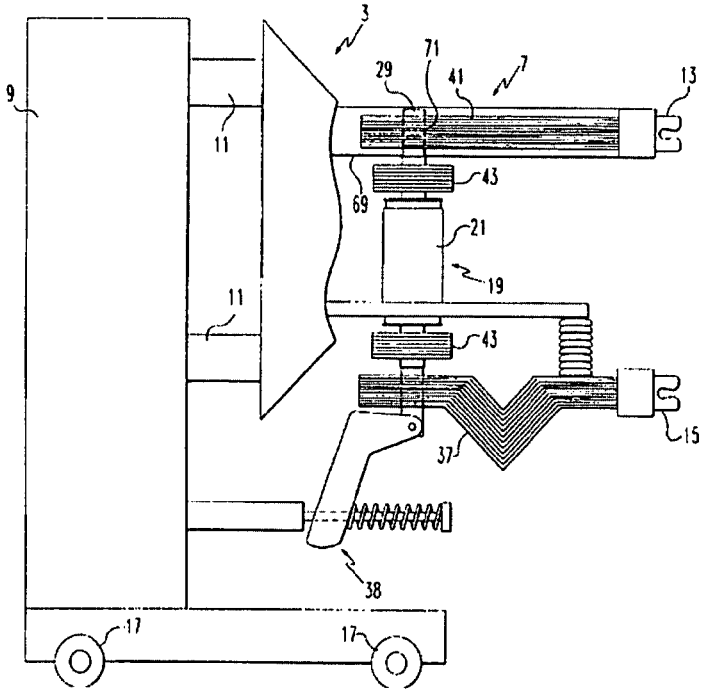
Fig. 2A Prior Art
FIG. 2A shows a CB with heat sinks on its contact stems disclosed in the prior art.
Figure 2B:
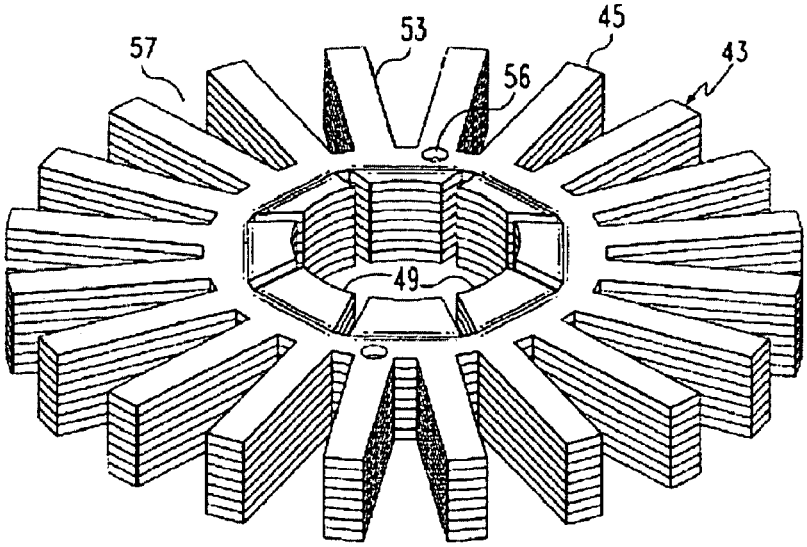
Fig. 2B Prior Art
FIG. 2B shows in more detail the construction of a heat sink for the CB shown in FIG. 2.
Figure 3:
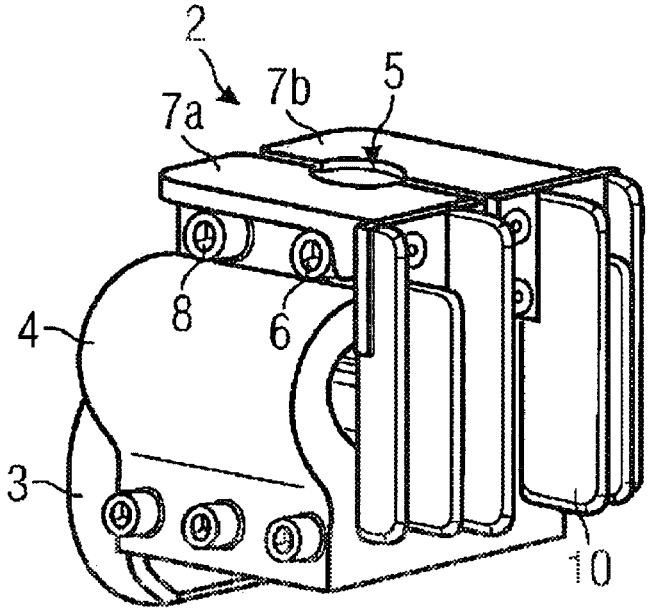
Fig. 3 Prior Art
FIG. 3 shows a coupling device with cooling elements for coupling a contact stem of a CB to its movable contact.
Figure 4A:
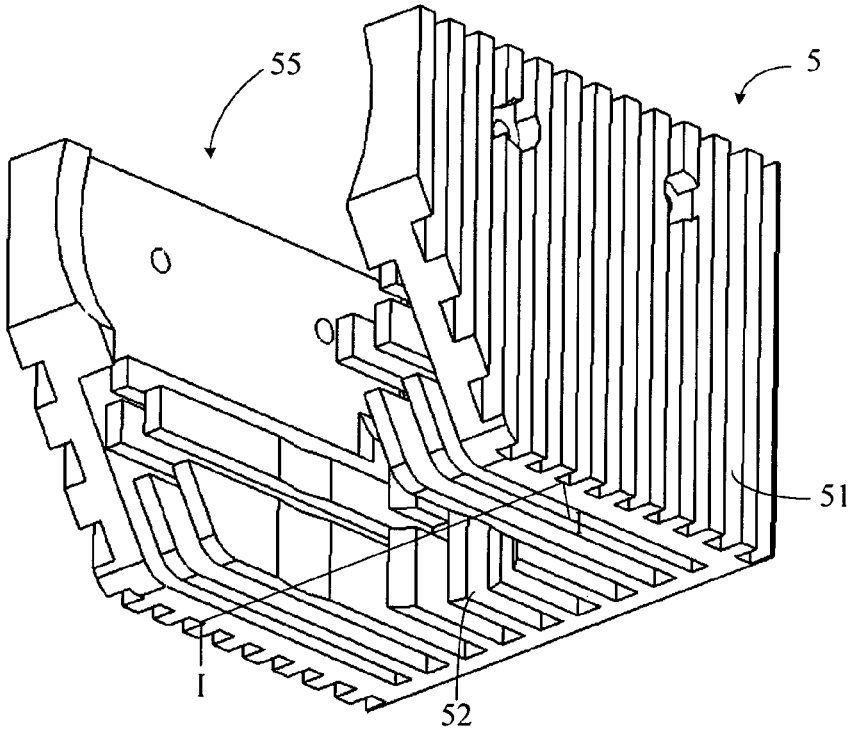
FIGS. 4A and 4B show the structure of a heat dissipating means in accordance with a preferred embodiment of the present invention.
Figure 4B:
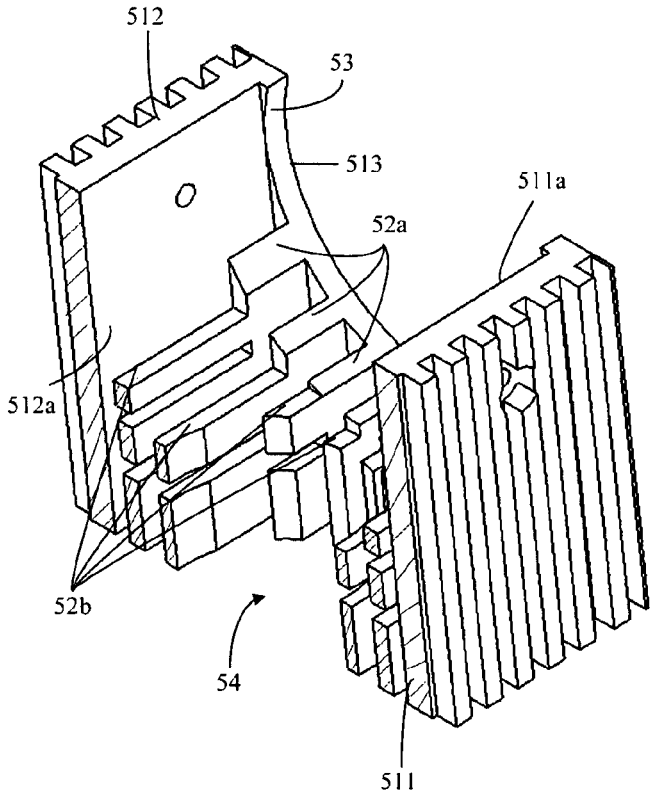

FIG. 4A is a view showing the structure of the heat dissipating element 5, FIG. 4B is a sectional view taken along line I-I in FIG. 4A for showing the internal structure of the element 5 in more detail. When installed, the heat dissipating element 5 will be accommodated with the electrical conductor 4 shown in FIG. 7. The external slots 51 on the heat dissipating element 5 are perpendicular to ground where the CB is installed.

The heat dissipating element 5 comprises a housing 51 composed of three walls 511, 512, and 513, the external surfaces of which form an external portion of the element 5. A half-opened hole 53 is formed in wall 513 for the electrical conductor 4 to get through. The diameter of hole 53 should match the outer diameter of the corresponding portion of electrical conductor 4, so that when installed, the surface of the hole 53 fully and firmly engages the outer surface 42*a* of the corresponding portion of electrical conductor 4. Therefore, heat can be efficiently transferred from electrical conductor to heat dissipating element 5 via the interface between them. Walls 511 and 512 are opposite and extend generally parallel to each other and perpendicular to wall 513, such that the three walls 511, 512, and 513 form a housing, e.g. a "U" shaped housing. When installed, the inner surface 511*a* of the wall 511 will engage a portion 41*a* of the outer surface of the conductor 4, and the inner surface 512*a* will engage a corresponding portion of the conductor 4. A plurality of fins 52, perpendicularly extend from the wall 513, are provided on the internal surface of the dissipating element, and they are elongated inward to the internal space of the housing. The fins are such shaped that an opening 54 is formed for the operating rod 10 to get through. As shown in the accompanying figures, the internal portion of the heat dissipating element 5 provides a vertical passage 55 for efficiently convecting air through. The fins 52 are separated from each other so that cooling air can convect naturally. More specifically, cool air in the dissipating element is heated by the fins 52. Since the heated air has a smaller density than that of cool air, the heated air will circulate and convect through the passage 55. In the process of this atmospheric convection, the heat generated in the device is carried away. It should be noted that the direction of air convection is parallel to the direction of reciprocal movement of the movable contact stem. For example, the direction of passage 55 and convection is vertical to the ground when the circuit breaker is vertically installed, as seen from FIG. 9.

To more effectively conduct heat from the electrical conductor 4, the heat dissipating element 5 is adapted to increase contacting surface area with the conductors. For example, some of the fins 52 are so shaped that their faces 52*a* have a profile matching a portion 42*a* of the outer surface of the conductor 4. And some of the fins are also particularly shaped that their faces 52*b* have a profile matching another portion 41*b* of the outer surface of the conductor 4.

As noted above, heat will be carried away by cool air circulating through the passage 55 of heat dissipating element 5. With the above structure, first, heats generated in the circuit breaker are conducted to the heat dissipating element 5. Then, the circuit breaker is thereby cooled by air convection that occurred in the passage 55 of heat dissipating element 5. Furthermore, the fins 52 are designed to extend in a direction substantially parallel to the inserting direction of conductor 4. The contacting surface area of the dissipating element and conductor are thereby greatly increased. Since the increased contacting surface area improves heat transfer, the heat can be dissipated to the surroundings more efficiently. A convection simulation shows that heat transfer efficiency is increased by 10-30% with the embodiments of present invention, which depends on the total contacting (dissipating) surface area of the fins.

To further increase the heat dissipating area, the external surface of the housing 51 is provided with a plurality of slots 51*a*. To further take advantage of atmospheric convection, the slots are preferably formed vertically, as shown in FIGS. 4A and 4B. That is, when installed, the slots extend in the direction perpendicular to the ground.

In addition, as shown in FIG. 9, the coupling means 9 is located above the heat dissipating element 5, air flowing through the element 5 is directed to the coupling means 9 to further increase heat dissipation. It should be noted that the heat dissipating element 5 can be installed on at least one of the contact stems and conductors also.

Figure 5A:
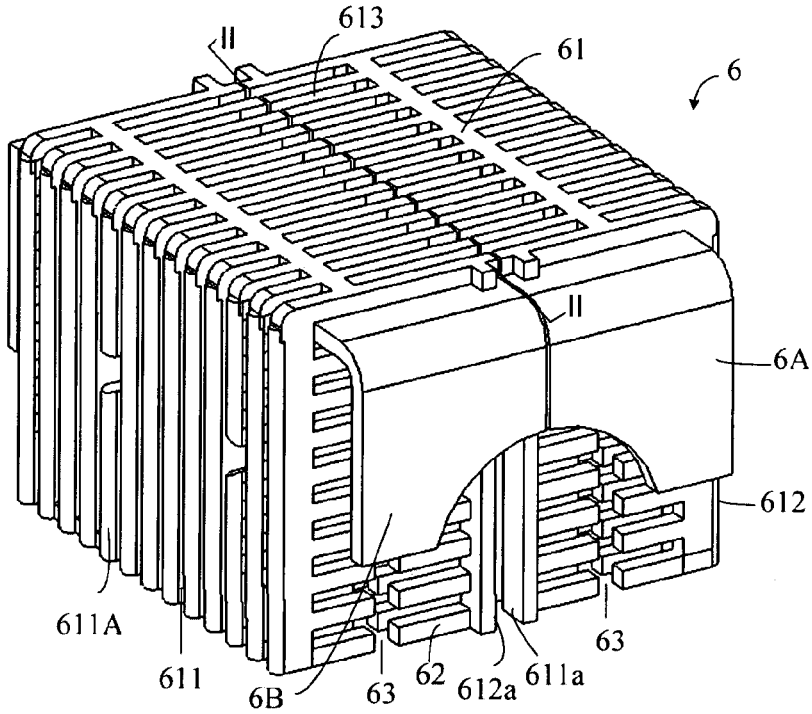
FIGS. 5A-5C show the structure of a heat dissipating means in accordance with another preferred embodiment of the present invention.
Figure 5B:
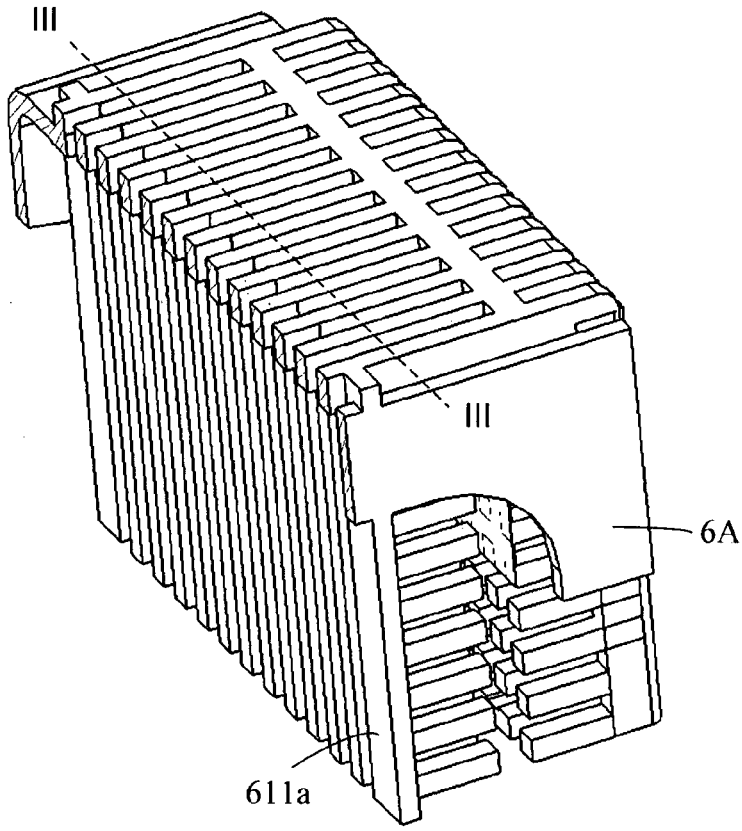
Figure 5C:
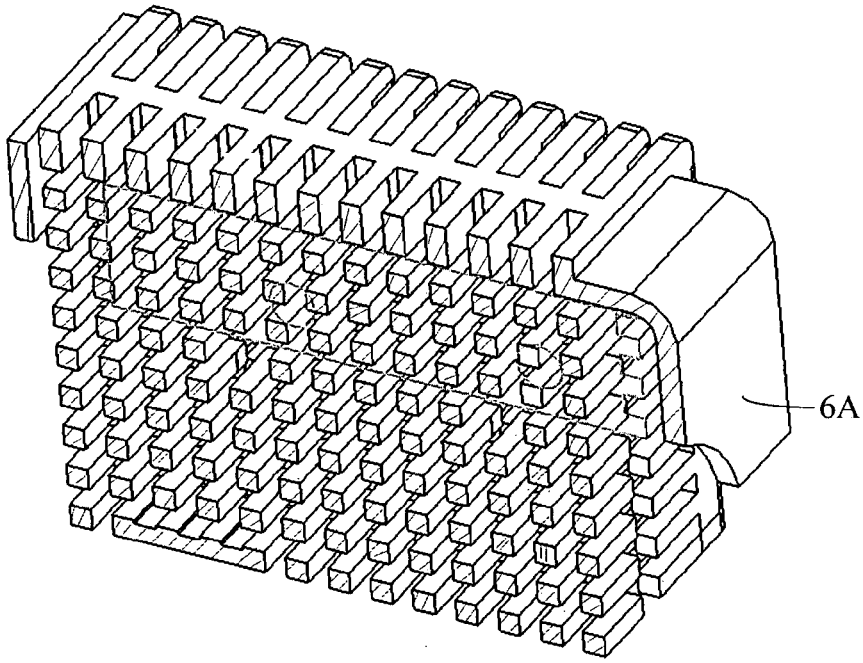

FIG. 5A is a view showing the structure of the heat dissipating element 6, FIGS. 5B and 5C are sectional views taken along lines II-II and III-III in FIG. 5A respectively for showing the structure of the element 6 in more detail. When installed, the heat dissipating element 6 will be accommodated with the electrical conductor 3 shown in FIG. 8.

Heat dissipating element 6 also comprises a housing 61 which is composed of three walls 611, 612, and 613. The walls 611 and 612 are opposite and parallel to each other. Wall 613 is perpendicular to walls 611 and 612, and connects walls 611 and 612 to form a "U" shaped housing. Walls 611 and 612 are in the form of barriers with a plurality of rails 611A parallel to and separated from each other. Fins 62 extend from each rail 611A inwardly to the inner space of the housing 61. Fins 62 are parallel to each other and generally perpendicular to the rails 611A so as to form a plurality of comb-like structures juxtaposed with and separated from each other.

In an embodiment of the present invention, each of the said comb-like structures is formed by a plurality of alternate short fins and long fins joined together. The short and long fins are joined with one of the end surfaces of each fin co-plane with a corresponding end surface of another fin so as to form the back of a comb, which serves as a rail of the barriers. The other ends or free ends of the long fins serve as the fins extending into the inner space of the housing.

In an embodiment of the present invention, heat dissipating element 6 is composed of two parts, each with the structure as described above, as shown in FIG. 5B. That is, one part comprises walls 611 and 612*a* and fins 62 extending there from, another part comprises walls 612 and 611*a* and fins 62 extending there from. The two parts are jointed together to form a complete heat dissipating element 6. In such a configuration, the fins 62 extending from two opposite walls form a passage 63 with their opposite free ends to accommodate a beam 311 or 312 so that when installed, each of the free ends firmly engage a side surface 311*a*, 311*b*, or 312*a*, 312*b*. With this configuration, heat generated in the conductor 3 can be efficiently transferred to the dissipating element 6.

Figure 6A:
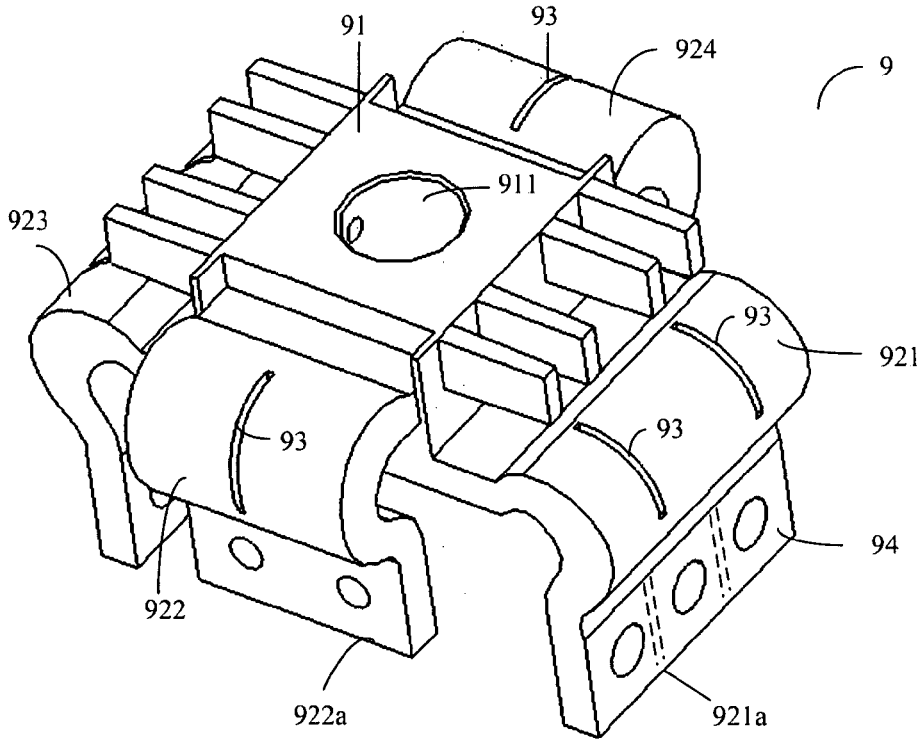
FIGS. 6A and 6B show the structure of a coupling element in accordance with a preferred embodiment of the present invention.
Figure 6B:
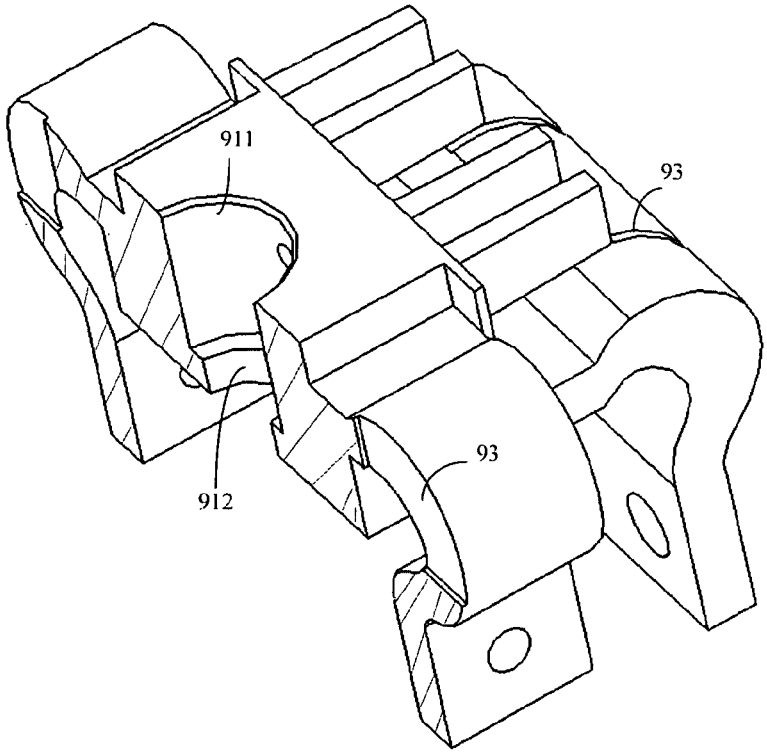

To further improve heat dissipation, the present invention also provides an improved coupling means 9 for coupling the movable contact stem of the CB to the corresponding electrical conductor 4. FIGS. 6A and 6B show the structure of this coupling means 9.

As can be seen from FIG. 6A, the coupling means 9 comprises a first connecting element 91 to connect the movable contact stem, and a second connecting element to connect the electrical conductor 4. The first connecting element 91 is formed with a hole 911 to accommodate the movable contact stem. The second connecting element is composed of flexible connecting means which comprises a plurality of pieces 921, 922, 923, and 924 to improve connecting reliability and increase heat dissipating surfaces. Compared with conventional couplers, the coupling element of the present invention composed of a plurality of pieces may have thinner profiles to improve flexibility thereof. In a preferred embodiment, each piece of the flexible connecting means is provided with at least one longitudinal slot 93 as shown in FIGS. 6A and 6B to further improve flexibility. In a still further preferred embodiment, the lower end of a slot 93 extends down to the edge of the piece that the slot 93 is in, for example, edge 921*a* of piece 921, so that the fastening portion 94 of the piece is split into sub-pieces; the contact between the second connecting element and the electrical conductor 4 will be more reliable, so as to further reduce the contact resistance, and thereby further reduce heat generated at the junction due to the contact resistance.

Figure 6C:
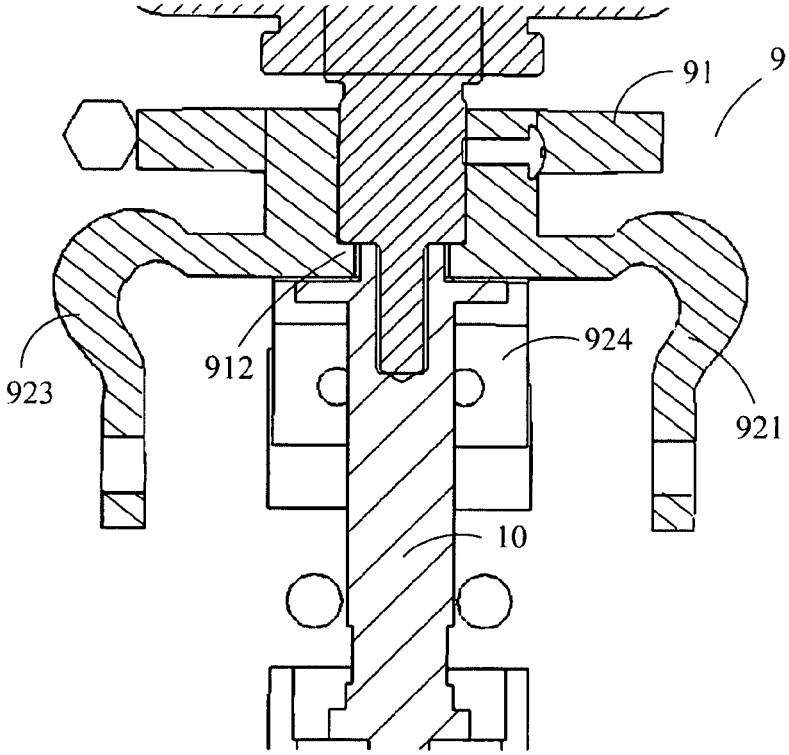
FIG. 6C shows in a sectional view of the structure of the coupling means when installed in a CB.

In a further preferred embodiment of the present invention, the hole 911 is provided with a flange 912 to fit with the movable contact through a pushrod (operating rod) 10. As can be seen from FIG. 6C, the flange 912 is pushed against and engaged with the end of the movable contact stem so that the contact area between the coupling means 9 and the movable contact stem is increased, thereby reducing the contact resistance and reducing heat generated. A further advantage of this structure is that before finally fastening the coupling means 9 with the movable contact stem, the pushrod 10 supports the coupling means to define the installation position, so as to simplify installation of the CB.

Figure 7:
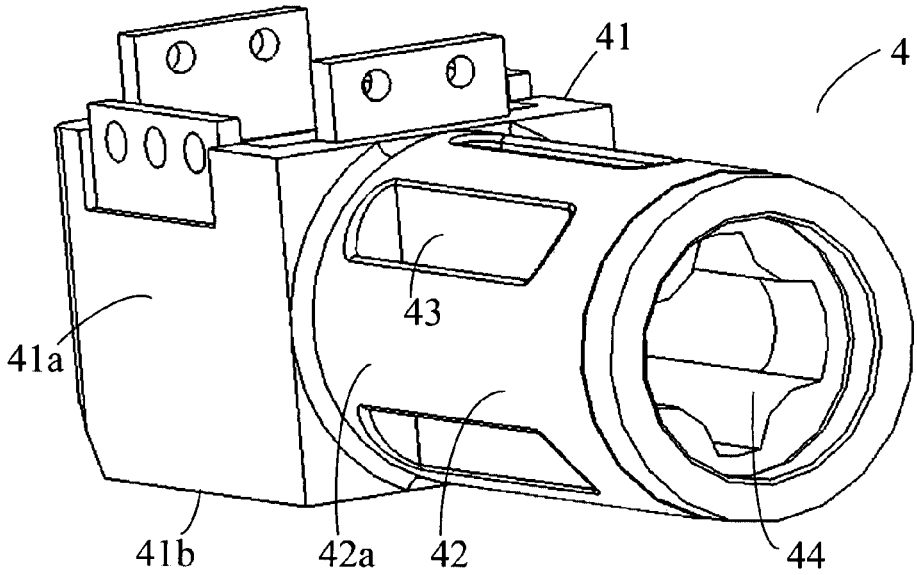
FIG. 7 shows the structure of a movable contact stem in accordance with a preferred embodiment of the present invention.
Figure 8:
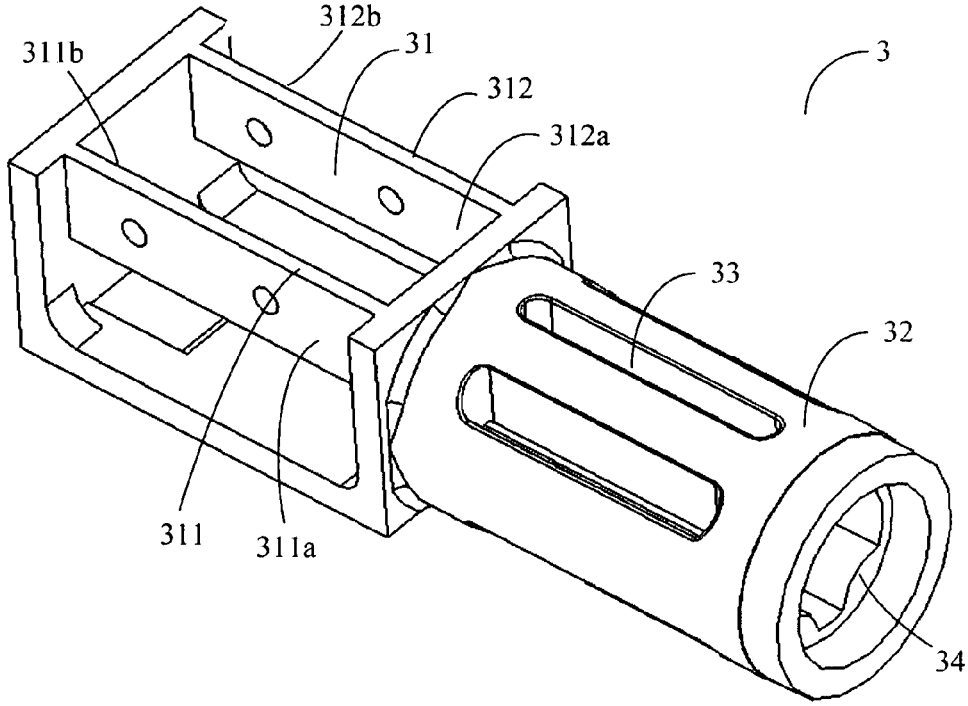
FIG. 8 shows the structure of a fixed contact stem in accordance with a preferred embodiment of the present invention.

FIGS. 7 and 8 show structures of the electrical conductors 4 and 3 respectively according to an embodiment of the present invention. As can be seen from the FIGS. 7 and 8, the electrical conductors respectively comprise joint portions 31, 41 and conducting portions 32, 42. The joint portion 31 is designed to connect the fixed contact stem and accommodate the heat dissipating element 6, and the joint portion 41 is designed to connect the coupling means 9 and accommodate the heat dissipating element 5. The conducting portions 32 and 42 are designed to further improve heat dissipating and current conducting.

Take the conducting portion 42 as an example. As shown in FIG. 7, the conducting portion 42 is a hollow cylinder with longitudinal slots 43 thereon, and the inner surface of the cylinder is formed with longitudinal ribs 44 such that the inner surface is in undulation in the circumferential direction. With such a structure, the area of the inner surface is enlarged so that heat generated in the contact stem can be dissipated more efficiently. With this structure, the cross section area of the contact stem that conducts currents effectively is enlarged so that more area is available for current flowing through the electrical conductor. For a given rated load, this means that the material for forming the electrical conductor can be thinner, which provides more inner space for air to flow so as to improve heat dissipation more efficiently.

Though the present invention has been described on the basis of some preferred embodiments, those skilled in the art should appreciate that those embodiments should by no way limit the scope of the present invention. Without departing from the spirit and concept of the present invention, any variations and modifications to the embodiments should be within the apprehension of those with ordinary knowledge and skills in the art, and therefore fall in the scope of the present invention which is defined by the accompanied claims.

What is claimed is:

1. A circuit breaker, comprising:

a vacuum chamber;

a fixed contact and a movable contact disposed in said vacuum chamber;

a fixed contact stem supporting said fixed contact in said vacuum chamber and extending outwards from a first end of said vacuum chamber;

a movable contact stem supporting said movable contact in said vacuum chamber for reciprocal movement between contact with and separated from said fixed contact, and extending outwards from a second end of said vacuum chamber;

a first electrical conductor coupled to said fixed contact stem, wherein the first electrical conductor is coupled to the fixed contact stem at a first conjunction;

a second electrical conductor coupled to said movable contact stem, wherein the second electrical conductor is coupled to the movable contact stem at a second junction; and at least one heat dissipating means provided for at least one of said fixed contact and movable contact, wherein the heat dissipating means is hollow and has an external surface and internal surface, and the internal surface has at least three fins separated from each other in a direction of air convection, wherein the heat dissipating means is coupled to at least one of the first junction and second junction, and wherein the at least one heat dissipating means includes a first wall, a second wall and a third wall, wherein the first wall and the second wall are parallel to each other and extend respectively from two edges of the third wall in a same direction generally perpendicular to the third wall.

2. The circuit breaker according to claim 1, wherein said fins are arranged to protrude from said internal surface with only one of its ends fixed to the internal surface.

3. The circuit breaker according to claim 1, wherein the fins are arranged to define the direction of air convection parallel to the direction of reciprocal movement of the movable contact stem.

4. The circuit breaker according to claim 1, wherein either of the first electrical conductor and the second electrical conductor is arranged to be held by at least two of the fins.

5. The circuit breaker of claim 1, wherein said external surface is formed with a plurality of slots in a direction generally perpendicular to the ground when installed.

6. The circuit breaker of claim 1, wherein an opening is formed in the third wall for the second electrical conductor to go through.

7. The circuit breaker of claim 1, wherein said first wall and second wall are formed with a plurality of rails parallel to and separated from each other.

8. The circuit breaker of claim 1, further comprising:

a coupling means for coupling said second electrical conductor to said movable contact stem, the coupling means comprising:

a first connecting element to connect the movable contact stem; and a second connecting element to connect the second electrical conductor, the second connecting element comprising:

a flexible connecting means composed of separated pieces connected to the first connecting element.

9. The circuit breaker of claim 1, the first electrical conductor comprising:

a joint portion; and a conducting portion, wherein the conducting portion is in the form of a hollow cylinder with longitudinal slots on it, and the inner surface of the cylinder is formed with longitudinal ribs.

10. The circuit breaker of claim 1, the second electrical conductor comprising:

a joint portion; and a conducting portion, the conducting portion is in the form of a hollow cylinder with longitudinal slots on it, and the inner surface of the cylinder is formed with longitudinal ribs.

11. The circuit breaker of claim 1, wherein the circuit breaker is a movable circuit breaker.

12. The circuit breaker of claim 6, wherein a diameter of said opening matches an outer diameter of the second electrical conductor, so that the third wall and the second electrical conductor firmly engage each other when installed.

13. The circuit breaker of claim 12, wherein the fins extend from said third wall inwardly in a direction generally perpendicular to said third wall, and are separated from each other.

14. The circuit breaker of claim 7, wherein the fins extend from each of the rails inwardly in a direction generally perpendicular to said rails and are separated from each other.

15. The circuit breaker of claim 7, wherein each of said rails is formed of a plurality of short fins and long fins alternately joined together, with each of the short fins and the long fins having an end surface co-plane with corresponding end surfaces of other fins, and the other ends of the long fins form the fins.

16. The circuit breaker of claim 7, the circuit breaker comprising: at least two heat dissipating means.

17. The circuit breaker of claim 8, wherein the flexible connecting means is composed of at least three separated pieces.

18. The circuit breaker of claim 17, wherein each of the separated pieces is formed with at least one longitudinal slot thereon.

19. The circuit breaker of claim 8, each of the pieces comprising: a joint portion for connecting the second electrical conductor.

20. The circuit breaker of claim 19, wherein the joint portion is formed with at least one longitudinal slot by which the joint portion is divided into sub-pieces.

21. The circuit breaker of claim 8, wherein the first connecting element is formed with a hole to accommodate the movable contact stem, a flange being formed on the inner surface of said hole, and when installed, said flange engages with an end surface of said movable contact stem.

* * * * *